US008550526B2

(12) United States Patent
Wade

(10) Patent No.: US 8,550,526 B2
(45) Date of Patent: Oct. 8, 2013

(54) ROPE HANDLING APPARATUS AND METHOD

(75) Inventor: Colin Maxwell Wade, Suffolk (GB)

(73) Assignee: Clinch-tech Limited, Bury St. Edmunds (GB)

( * ) Notice: Subject to any disclaimer, the term of this patent is extended or adjusted under 35 U.S.C. 154(b) by 145 days.

(21) Appl. No.: 13/028,540

(22) Filed: Feb. 16, 2011

(65) Prior Publication Data

US 2011/0198876 A1 Aug. 18, 2011

(30) Foreign Application Priority Data

Feb. 17, 2010 (GB) ..... 1002690.4

(51) Int. Cl.
*B66F 19/00* (2006.01)

(52) U.S. Cl.
USPC .... 294/191; 294/209; 114/221 R; 114/230.26

(58) Field of Classification Search
USPC ..... 294/191, 209, 175; 114/230.2, 230.26, 114/221 R
See application file for complete search history.

(56) References Cited

U.S. PATENT DOCUMENTS

| | | | | |
|---|---|---|---|---|
| 3,224,404 | A * | 12/1965 | De Jong | 114/230.25 |
| 3,841,685 | A * | 10/1974 | Kolodziej | 294/100 |
| 3,945,335 | A | 3/1976 | Kratz | |
| 4,519,643 | A * | 5/1985 | Harris | 294/210 |
| 4,661,077 | A * | 4/1987 | Griffith et al. | 441/84 |
| 5,381,749 | A * | 1/1995 | Larson | 114/221 R |
| 5,634,421 | A * | 6/1997 | Velarde | 114/230.15 |
| 5,699,748 | A * | 12/1997 | Linskey et al. | 114/221 R |
| 5,752,731 | A * | 5/1998 | Crone | 294/24 |
| 6,928,945 | B1 * | 8/2005 | Tebo, Jr. | 114/230.15 |
| 7,810,442 | B2 * | 10/2010 | Duarte et al. | 114/230.2 |
| 2008/0156245 | A1 * | 7/2008 | Duarte et al. | 114/230.15 |
| 2009/0255100 | A1 | 10/2009 | Stone | |
| 2010/0201141 | A1 * | 8/2010 | Wright | 294/19.1 |

FOREIGN PATENT DOCUMENTS

| | | |
|---|---|---|
| DE | 10156166 | 5/2003 |
| FR | 2 629 418 | 10/1989 |
| GB | 2459123 | 10/2009 |
| JP | 2004345614 | 12/2004 |
| WO | WO 2008006159 A1 * | 1/2008 |

* cited by examiner

*Primary Examiner* — Saul Rodriguez
*Assistant Examiner* — Gabriela Puig
(74) *Attorney, Agent, or Firm* — Burr & Brown

(57) ABSTRACT

A rope handling device for handling a length of rope comprises a receiving part and a manipulating member, in which the manipulating member has an elongate portion, the elongate portion having opposite ends, and at least one of these ends an engagement portion. The receiving part has a rope mounting portion, attachable to a part of a rope to be manipulated, and a receptacle for engaging with the engagement portion. The receiving part when engaged with the engagement portion at one of the ends of the elongate portion permits a user of the device to hold the manipulating member at an opposite end of the elongate member in order to handle a rope attached to the rope mounting portion. The rope handling apparatus further comprises a rope guide for self-aligning the manipulating member with a rope prior to engagement of the engagement portion with the receptacle.

18 Claims, 8 Drawing Sheets

ROPE HANDLING APPARATUS AND METHOD

BACKGROUND a. Field of the Invention

The present invention relates to an apparatus and method for handling a length of rope using a hand-held device, when the length of rope is at a distance from the user of the apparatus.

b. Related Art

When mooring a boat, for example a pleasure boat, at a mooring or dock it is often difficult or inconvenient to jump ashore and tie the boat up to a bollard. This may be because the boat is being operated single handedly, in which case the skipper will have to leave the helm, or because it is difficult to get close enough to the dock to able to jump ashore.

It may be possible to throw a loop of rope so that it falls around the bollard; however, this is usually difficult and often takes several attempts. In many situations it is necessary to be able to tie the boat to the bollard quickly before the boat drifts too far.

It is an object of the present invention to provide an apparatus and method for handling a length of rope that addresses these difficulties.

SUMMARY OF THE INVENTION

According to a first aspect of the invention, there is provided a rope handling apparatus comprising a receiving means and a manipulating member, in which:

the manipulating member has an elongate portion, the elongate portion having opposite ends, and at least one of said ends an engagement portion;

the receiving means has a rope mounting portion, attachable to a part of a rope to be manipulated, and a receptacle for engaging with the engagement portion;

wherein the receiving means when engaged with the engagement portion at one of said ends of the elongate portion permits a user of the apparatus to hold the manipulating member at an opposite end of the elongate member in order to handle a rope attached to the rope mounting portion, the rope handling apparatus further comprising a guide means for self-aligning the manipulating member with a rope prior to engagement of the engagement portion with the receptacle.

Preferably the receptacle comprises a tapered opening and the engagement portion comprises a tapered end region, and wherein the tapered end region fits within the tapered opening of the receptacle. Because the receptacle and the end of the engagement portion are both tapered, this allows a user to easily insert the manipulation member into the receiving means.

Preferably the elongate portion comprises a handle portion such that a user may hold the manipulating member.

In use, the self-aligning guide means aligns the manipulating member with the rope as the engagement portion is slid along the rope towards the receptacle.

To aid in guiding the engagement portion along the rope the guide means preferably comprises a channel in which the rope may be seated for self-aligning the manipulating member with a rope.

To enable the rope to be manipulated at a distance from the user it is preferred if the elongate portion is telescopic. This allows the handle to be extended when the rope handling apparatus is being used, and to be shortened when storing the manipulating member.

Preferably the rope mounting portion includes a cylindrical sleeve portion to secure the receiving means to a rope. In some circumstances it may be preferable if the cylindrical sleeve is made from a heat shrinkable material. In other embodiments the cylindrical sleeve includes O-rings that extend around the sleeve for securing the cylindrical sleeve to a rope.

The receiving means and manipulating member may be held together by the user pulling on the rope to keep the engaging portion within the receptacle. An advantage of such passive engagement is that the engaging portion and the receptacle will come apart once the tension is released.

However, it is preferable if the receiving means and manipulating member comprise retaining features for positively retaining the end region of the engagement portion in the receptacle when the rope handling apparatus is used to manipulate a rope. Preferably the retaining features comprise a groove on one of either the receiving means or the engagement portion and a ridge on the other of either the receiving means or the engagement portion. The ridge is then locatable in the groove for positively retaining the end region of the engagement portion in the receptacle.

In some embodiments it is desirable if the engagement portion includes at least one projection for snagging a section of rope at a distance from a user when retrieving this section of rope, such that a section of rope may be retrieved before the engagement portion is engaged in the receiving means. Preferably at least one projection is a hook.

According to a second aspect of the invention, there is provided a rope handling system, comprising a rope and a rope handling apparatus for manipulating said rope, the rope handling apparatus comprising a receiving means and a manipulating member in which:

the manipulating member has an elongate portion the elongate portion having opposite ends, and at least one of said ends an engagement portion;

the receiving means has a rope mounting portion, said rope mounting portion being attached to a part of said rope, and a receptacle for engaging with the engagement portion;

wherein the receiving means when engaged with the engagement portion at one of said ends of the elongate portion permits a user of the apparatus to hold the manipulating member at an opposite end of the elongate member in order to handle said rope attached to the rope mounting portion, the rope handling apparatus further comprising a guide means for self-aligning the manipulating member with said rope prior to engagement of the engagement portion with the receptacle.

In some embodiments the rope includes a loop, the rope mounting portion being attached to the rope proximate the loop. A user can then manipulate the loop, for example by lowering and raising the loop, when the manipulating member is engaged with the receiving means.

In other embodiments the system includes a personal rescue device, for example a life ring or a rescue sling, attached to the rope. The rope mounting portion is then attached to the rope proximate the personal rescue device.

Also according to the invention, there is provided a method for handling a rope, using a rope handling apparatus, said apparatus comprising a receiving means and a manipulating member, the manipulating member having an elongate portion, the elongate portion having opposite ends, and at least one of said ends an engagement portion, and the receiving means having a rope mounting portion and a receptacle, the method comprising the steps of:

attaching the rope mounting portion to a part of a rope to be manipulated;

engaging the engagement portion with the receptacle; and holding the manipulating member at an opposite end of the elongate member to that of said engaged engagement portion in order to handle said rope;

wherein prior to said engagement of the engagement portion with the receptacle, the guide means is used to self-align the manipulating member with the rope.

In preferred embodiments of the invention, the guide means is part of the engagement portion such that as the manipulating member is self-aligned with the rope, the engagement portion is automatically aligned with the receptacle.

BRIEF DESCRIPTION OF THE DRAWINGS

The invention will now be further described, by way of example only, and with reference to the accompanying drawings, in which.

DETAILED DESCRIPTION

Figure 1:
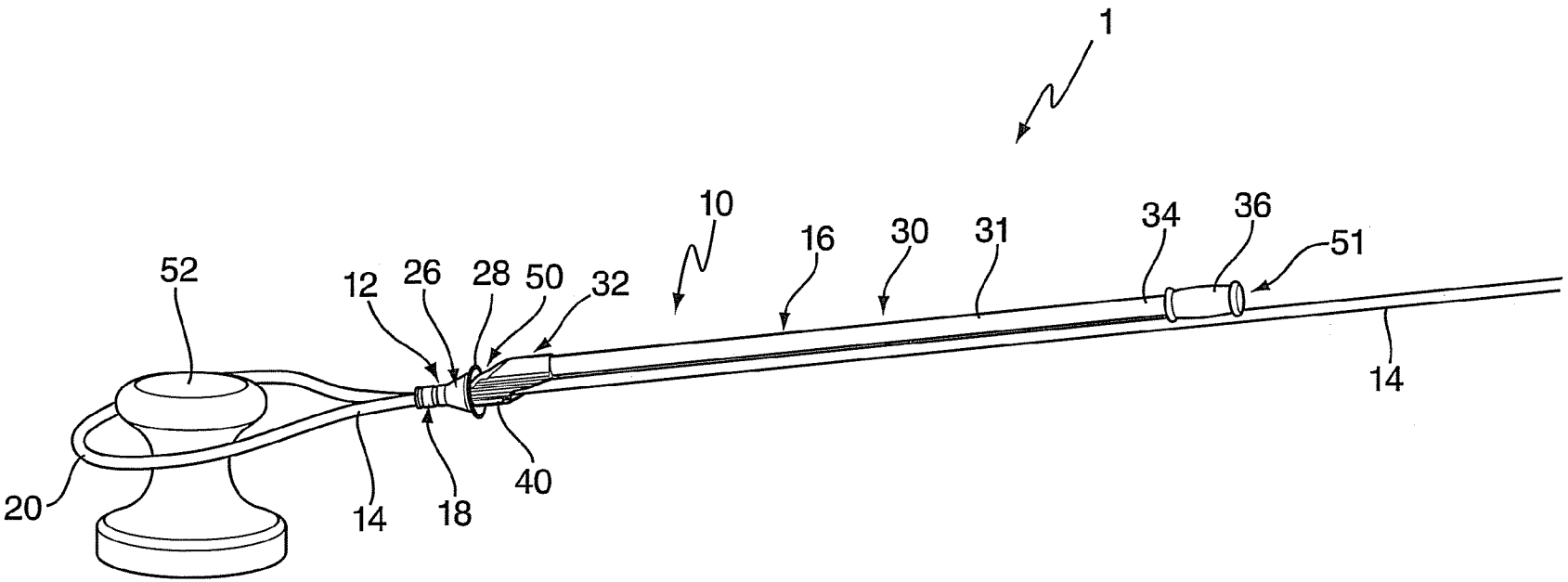
FIG. 1 shows a rope handling apparatus according to a first embodiment of the present invention, comprising an elongate manipulating member that has at one end an engagement portion that is engaged with a receiving means which is attached to a rope.

FIG. 1 shows a first embodiment of a rope handling system 1 including a rope 14 and a rope handling apparatus 10 according to a preferred embodiment of the invention. The rope handling apparatus 10 comprises two individual devices: a receiving means 12 that is attached to the rope 14 and an elongate manipulating member 16 that is held by a user of the apparatus 10 to manipulate, move, or otherwise handle the rope 14 at a distance from the user.

Figure 2:
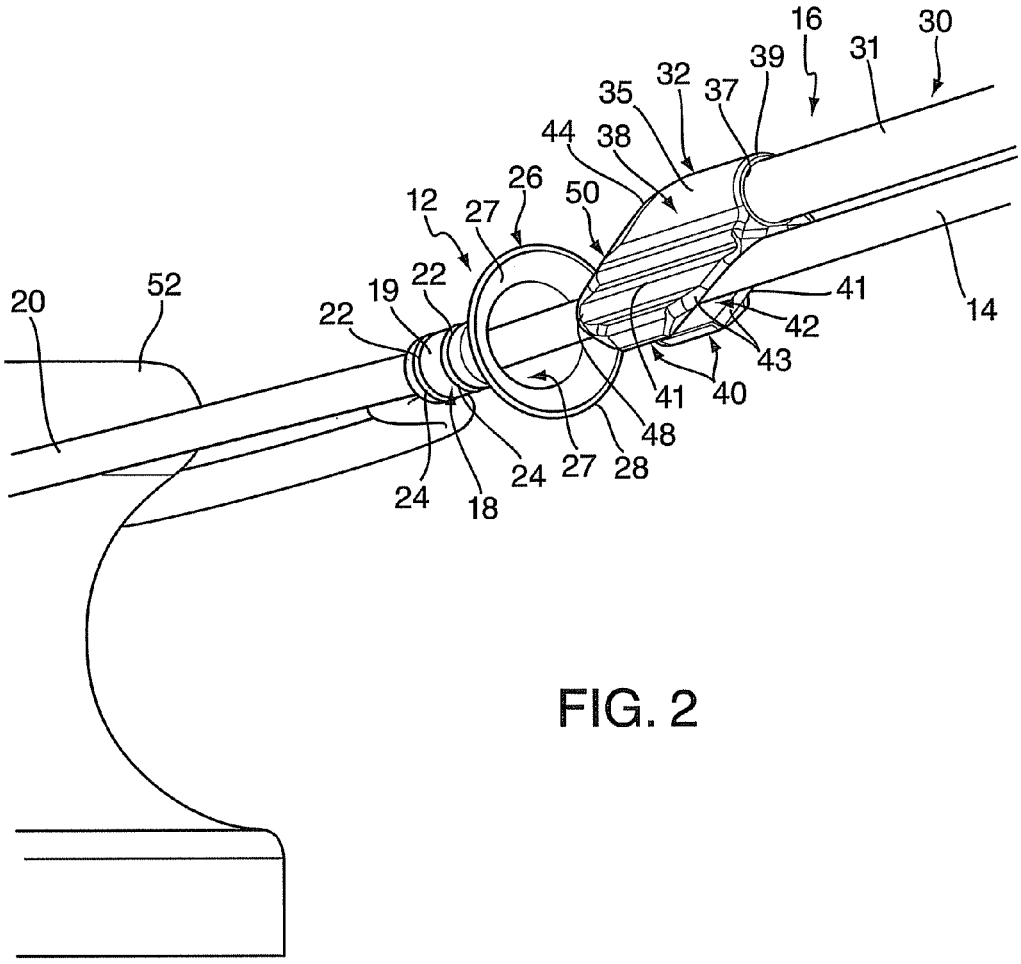
FIG. 2 is a view of the receiving means and engagement portion of the rope handling apparatus of FIG. 1.

The receiving means 12 is shown in more detail in FIG. 2, and comprises a rope mounting portion 18, which in this embodiment is a generally cylindrical rope clamping assembly 18 used to attach the receiving means 12 to the rope 14. The cylindrical clamping assembly 18 comprises a cylindrical sleeve 19 designed to initially have a bore having a larger diameter than the diameter of the rope 14 so that the receiving means 12 may be easily slid along the length of the rope 14 to the desired position. In this example the receiving means 12 also holds an end of the rope 14 within the bore of the cylindrical clamping assembly 18 so that the end of the rope 14 is formed into a loop 20.

Once in position the cylindrical sleeve 19 is secured to the rope 14 so that it does not slide along the length of the rope 14. In this embodiment the sleeve 19 is made of a flexible material and has two annular grooves 22 which are formed on an outside surface of the cylindrical sleeve 19, as shown most clearly in FIG. 2. The clamping assembly 18 is completed by two O-rings 24, or other elastomeric bands, which are seated in the grooves 22 to tighten the sleeve 19 and fasten it securely around the rope 14.

It will be appreciated that the receiving means 12 may be secured to the rope 14 in a number of different ways. In on embodiment (not illustrated), the rope mounting portion 18 comprises a cylindrical sleeve is made from a heat shrinkable material. Once the receiving means 12 has been placed over the rope 14 in the desired position, heat is applied to the heat shrink sleeve to cause it to shrink and tighten around the rope 14. Heat may be applied by pouring boiling water over the sleeve. In an alternative embodiment (not shown), the rope mounting portion may comprises a sleeve of that is adapted to be sewn to the rope 14.

The receiving means 12 also includes a receptacle 26. In this embodiment, the receptacle is at one end of the rope mounting portion 18 and is generally cup-shaped, having the form of a conical flange 25 that extends generally radially outwardly around the circumference of the cylindrical assembly 19. The conical flange 25 forms a tapered opening 27 directed away from the loop end of the rope 14 and towards a user of the apparatus 10 for engaging with a tapered end part or region 48 of the manipulating member 16. The wall of the conical receptacle 26 forms an angle of between about 15° and 45° to the longitudinal axis of the receiving means 12. In this example, the angle is, most preferably, between about 20° and 25°. A rim 28 extends outwardly from, the larger diameter edge of the conical receptacle 26.

In use, the receiving means 12 is oriented on the rope 14 so that the conical receptacle 26 extends along the length of the rope 14 away from the end of the rope, at which the loop 20 has been formed in this example.

The elongate manipulating member 16 comprises an elongate portion 30 and an engagement portion 32. In this example, the elongate portion 30 comprises a tubular member 31 having a circular cross-section. The engagement portion 32 is located at a distal end 50 of the tubular member 31, the function of which will be described below. A proximal end 51 of the elongate portion 30 comprises a handle portion 34 including a grip 36. In other embodiments (not shown), an engagement portion 32 may be provided at both ends 50, 51 of the tubular member 31, such that a user may hold either end of the manipulating member 16 to manipulate a rope.

Figure 4:
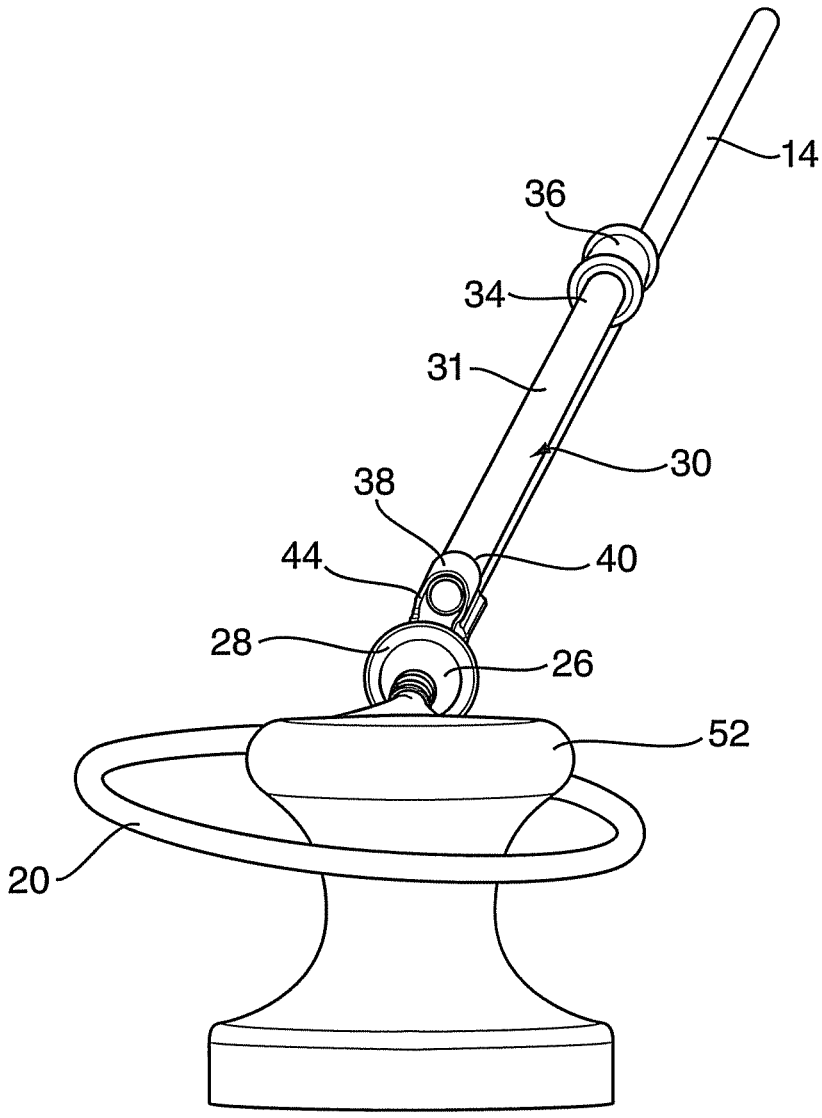
FIG. 4 is a perspective view of the rope handling apparatus of FIG. 1.
Figure 5:
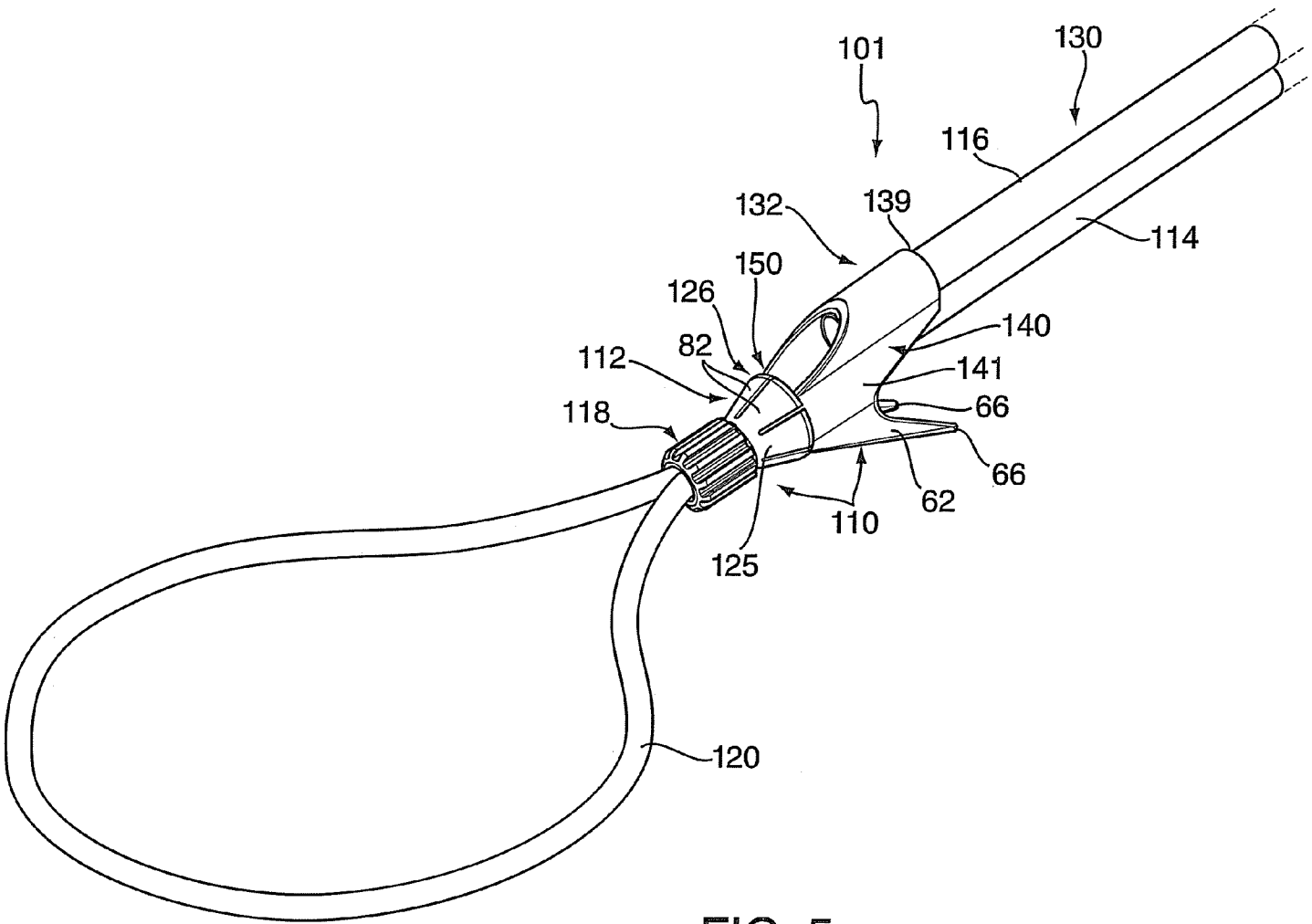
FIG. 5 shows a rope handling apparatus according to a second embodiment of the present invention, comprising an elongate manipulating member that has at one end an engagement portion that is engaged with a receiving means which is attached to a rope.
Figure 7:
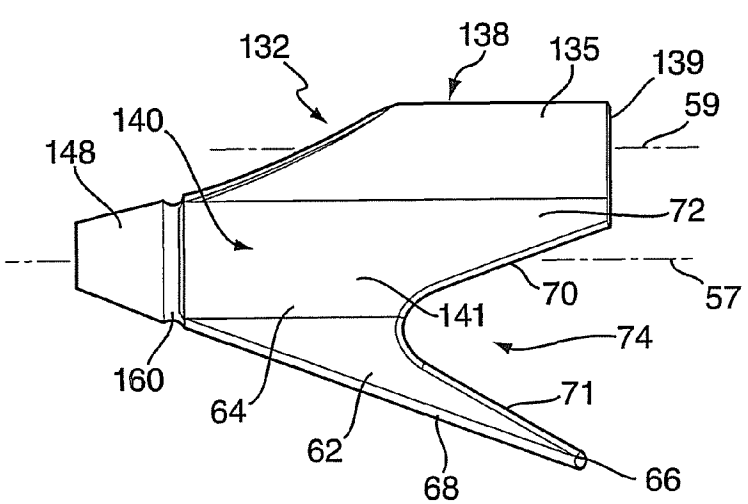
FIG. 7 is a plan view from the side of the engagement portion of FIG. 6.
Figure 9:
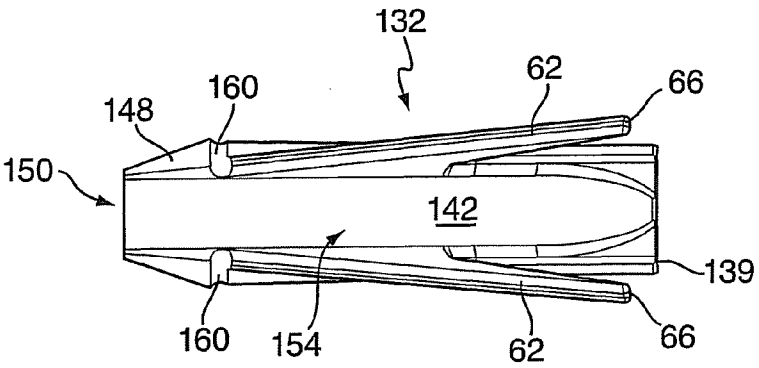
FIG. 9 is a plan view from underneath of the engagement portion of FIG. 6.
Figure 6:
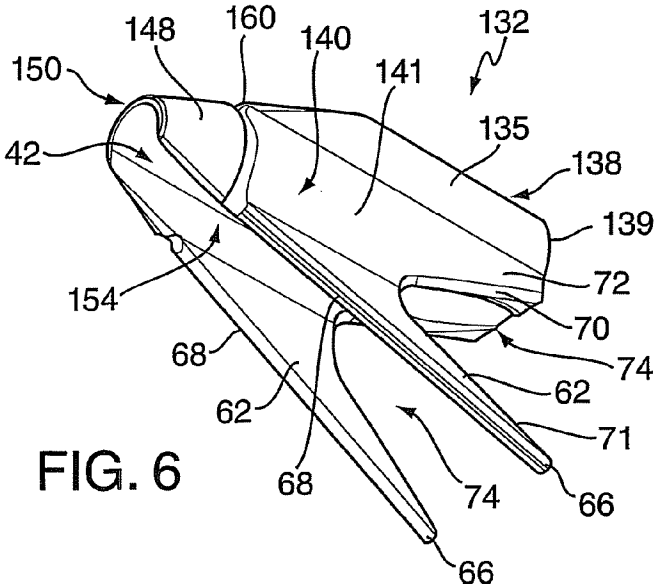
FIG. 6 is a perspective view of an engagement portion for use in a rope handling apparatus according to a second embodiment of the present invention.
Figure 8:
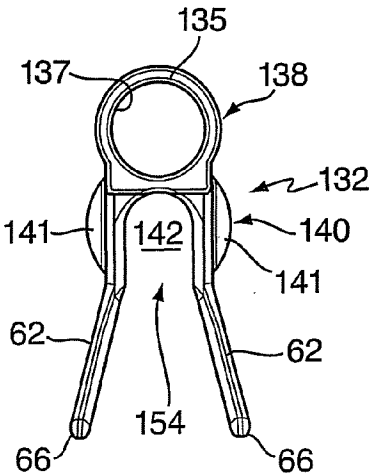
FIG. 8 is a plan view from the rear of the engagement portion of FIG. 6.

The engagement portion 32 comprises securing means 38 for securing the engagement portion 32 to the end of the tubular member 31. In this embodiment the securing means 38 comprises a hollow cylindrical portion 35 having a bore 37 with the diameter of the bore being only slightly larger than the outer diameter of the tubular member 31 so that there is a push-fit between the tubular member 31 and the securing means 38. The engagement portion 32 can then be slid over the end of the tubular member 31 so that the tubular member 31 extends away from a rear edge 39 of the cylindrical portion 35, as shown in FIG. 4. The push-fit between the tubular member 31 and the engagement portion 32 should be tight enough so that the engagement portion 32 does not rotate with respect to the tubular member 31. The securing means 38 may comprise additional means (not shown) for securing the fit between the engagement portion 32 and the tubular member 31 in the form of adhesive, a rivet, or similar to more firmly fix the engagement portion 32 to the end of the tubular member 31.

Figure 3:
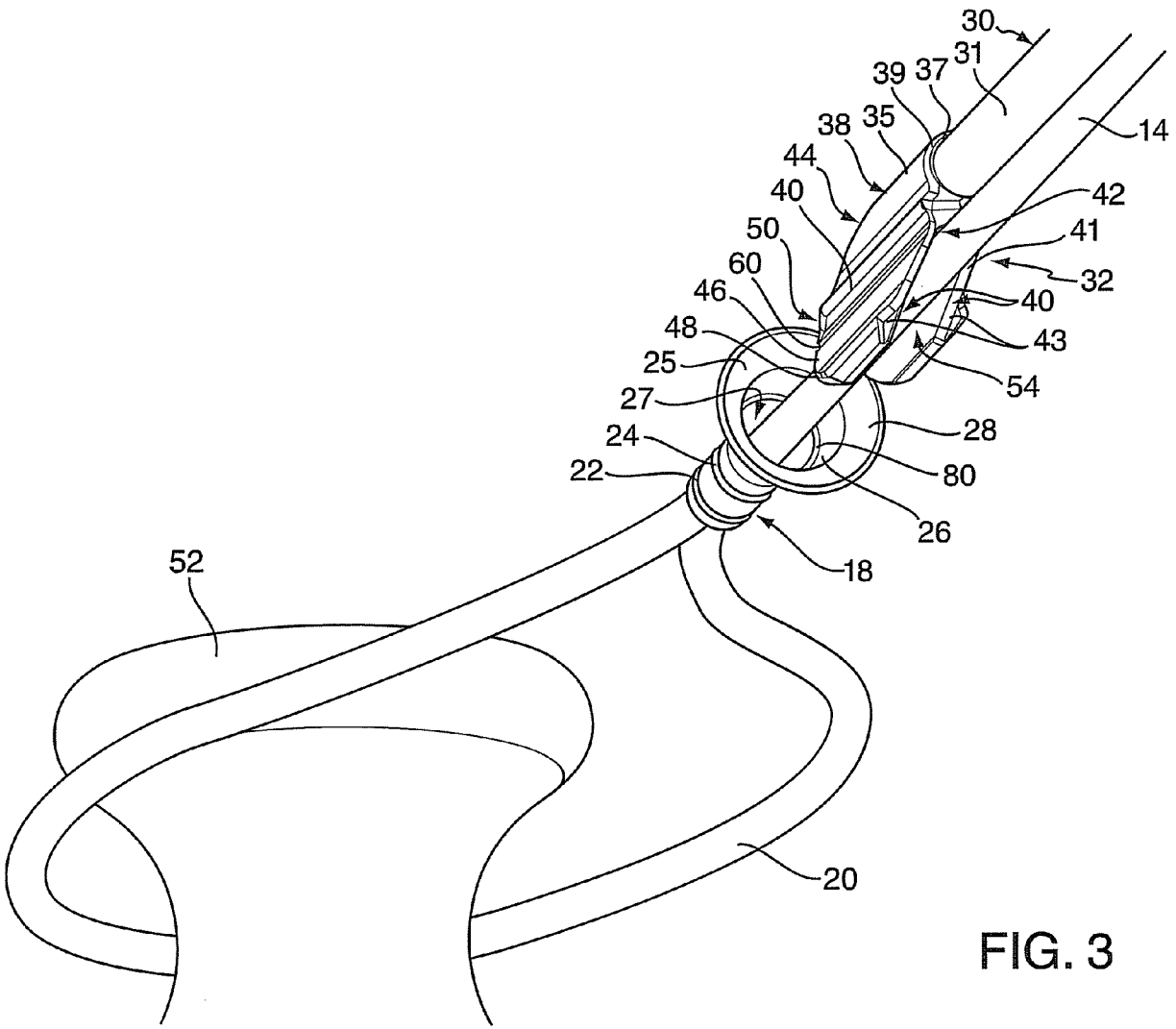
FIG. 3 is a second view of the receiving means and engagement portion of the rope handling apparatus of FIG. 1.

The engagement portion 32 also comprises a self-aligning guide means 40 in the form of a pair of guide plates 41 extending from the cylindrical portion 35. The guide plates 41 extend outwards from the wall of the cylindrical portion 35 along the full length of the cylindrical portion 35. The guide plates 41 extend in generally the same direction away from the cylindrical portion 35, and are, substantially parallel to each other and spaced apart, thereby defining an opening 54 that leads to a U-shaped channel or slot 42 between them, as shown most clearly in FIG. 3. At least a part 43 of the guide plates 41 may be splayed apart from each other so that the opening 54 is tapered. The side walls of the channel 42 are, therefore, formed by the guide plates 41 and the rounded base of the channel 42 is formed by a part of the outer surface of the cylindrical portion 35 of the securing means 38.

The width of the channel 42, or the gap between the guide plates 41, is slightly larger than the diameter of the rope 14 so that the rope may pass between the guide plates 41 and be seated in the channel 42. The engagement portion 32 is thereby automatically self-aligned with the rope 14 so that the engagement portion can be slid along the rope towards the receptacle 26.

A front edge 44 of the cylindrical portion 35 is sloped so that the side of the cylindrical portion 35 from which the guide plates 40 extend is longer than the opposing side. In addition, each guide plate 41 has a front edge 46 that is shaped so that these provide a portion of the generally tapered end region 48 of the engagement portion 32. The sloped end of the cylindrical portion 35 is continuous with the shaped edges of the guide plates 41 thereby defining the generally tapered end 48 to the engagement portion 32.

The angle of the tapered end 48 of the engagement portion 32 is approximately equal to the angle of the conical receptacle 26 of the receiving means 12. The tapered end 48 of the engagement portion 32 is therefore insertable in the conical receptacle 26.

In use, with a receiving means 12 already attached to an end of a rope 14, a user holds the grip 36 at the proximal end of the manipulating member 16 with one hand and lowers the guide means 40 over the rope 14 so that the rope 14 is seated within the channel 42. The engagement portion 32 is then slid along the rope 14 towards the receiving means 12 until the tapered distal end 48 is inserted into the tapered opening 27. With his other hand, a user pulls the rope 14 taught so that the manipulating member 16 can be pushed fully into the receiving means 12 until the tapered end region 48 mates with the inner surface of the tapered opening 27.

With a pushing force applied to the manipulating member 16 and a pulling force applied to the rope 14, the tapered end 48 of the engagement portion 32 is held within the receiving means 12, and the end of the rope 14 can then be lifted using the rope handling apparatus 10. The user can then hold the handle 34 of the manipulating member 16 at arms length and place the end of the rope 14, which in this example is formed into a loop 20, over an object such as a bollard 52. Once the rope 14 has been lowered over the bollard 52, the manipulating member 16 can be simply removed from the receiving means 12 by releasing the tension in the rope and pulling back the elongate member.

The length of the tubular member 31 is preferably significantly longer than the arm length of a person, for example, between 2 m and 4 m long, so that the end of the rope 14 may be handled at a distance from the user.

Optionally, the tubular member 31 is telescopic (not shown). In particular, the handle region 34 of the tubular member 31 comprises two or more tubular sections (not shown) slideable within one another such that the length of the handle region 34 may be extended or shortened depending on the distance between the end of a rope 14 and a user.

To help keep the engagement portion 32 engages within the receiving means 12, the engagement portion 32 and receiving means may be provided with a securing means to secure these components together so that the engagement portion does not disengage from the receiving means if the tension in the rope held by the user is lost for any reason. In this embodiment, the conical flange 25 of the receiving means 12 is made from a resilient and extendable material, such as rubber, and the engagement portion 32 has in the tapered end region 48 of the cylindrical guide means 40 an annular groove 60 that extends around the outer surface of the tapered end region 48 of the guide means 40. The receiving means 12 includes a corresponding annular ridge 80 around the inner surface of the conical receptacle 26. The ridge is directed radially inwards so that this may engage with the groove 60. As shown most clearly in FIG. 3, the positions of the groove 60 and ridge 80 are such that the ridge locates in the groove when the tapered end region 48 of the engagement portion 32 inserted into the conical receptacle 26 of the receiving means 12. The groove 60 and ridge 80 therefore engage to positively retain the end 50 of the manipulating member 16 in the conical receptacle 26 during use. The manipulating member can be easily removed from the receiving means by pulling sharply on the handle to disengage the groove and ridge.

FIGS. 5 to 11 show various views of a second preferred embodiment of a rope handling system 101 according to a second preferred embodiment of the invention, in which features similar to those of the first embodiment 1 are indicted using reference numerals incremented by 100. The rope handling system 101 comprises including a rope 114 and a rope handling apparatus 110 The rope handling apparatus 110 comprises two individual devices: a receiving means 112 that is attached to the rope 114 and an elongate manipulating member 116 that is held by a user of the apparatus 110 to manipulate, move, or otherwise handle the rope 114 at a distance from the user. The second embodiment 101 works in a similar way to the apparatus described above, but differs from the first embodiment 1 in the form of the receiving means 112 and the engagement portion 132.

The receiving means 112 also includes a receptacle 126 and a rope mounting portion 118. This embodiment of the receiving means 112 differs from the first embodiment 12 in that the rope mounting portion 118 is a cylindrical rope clamping assembly 118 secured by a compression nut 84. Also in this embodiment, the receptacle is not formed from the elastomeric material used in the first embodiment, but is made of a hard but flexible and resilient plastic material. The receptacle 126 is generally cup-shaped, the form of a conical flange 125 that extends from the cylindrical rope clamping assembly generally radially outwardly around the circumference of the assembly 118, which will be described in more detail below. The conical flange 125 is split with slots 81 into a plurality of separate fingers 82 which extend away from the clamping assembly 118 to form a tapered opening 127 directed away from the loop end 120 of the rope 114 and towards a user of the apparatus 110 for engaging with a tapered end part or region 148 of the manipulating member 116. The wall of the conical receptacle 126 forms an angle of between about 15° and 45° to the longitudinal axis of the receiving means 112. In this example, the angle is, most preferably, between about 20° and 25°. A rim 128 extends outwardly from the larger diameter edge of the conical receptacle 126.

FIGS. 6 to 9 show in more detail the engagement portion 132. As described above, the engagement portion 132 is fixed to an end 150 of an elongate portion 130 as the same as that described above to form the manipulating member 116 for moving and manipulating a length of rope at a distance from the user. Optionally, two such engagement portions 132 may be fixed at each end of the elongate portion 130.

In this embodiment, the engagement portion 132 comprises a securing means 138 and a self-aligning guide means 140. The guide means 140 comprises a generally U-shaped channel or slot 142 for self-aligning with the rope 114. The guide means has a longitudinal axis 57 that is parallel to but offset from a longitudinal axis 59 of a bore 137 of a hollow cylindrical portion 135 of the securing means 138. The guide means 140 has a pair of walls 141 that project away from the securing means 138 along the full length of the hollow cylindrical portion 135. The spacing between the walls 141 provides the U-shaped channel 142. The opening 154 leading to the channel 142 therefore runs the full length of the guide means 140. The width of the opening 154 is slightly larger than the diameter of the rope 114 so that the rope may pass through the opening 154 and be seated in the channel 142 of the cylindrical guide means 140.

A front end 150 of the cylindrical guide means 140 includes a tapered end region 148. In this region the width of the channel 142 remains constant and the external diameter of the guide means 140 decreases to a minimum at the front end of the guide means 140. The engagement portion 132 includes a part-annular groove 160 extending around the outer surface of the tapered end region 148 of the guide means 140. The groove has a similar shape and serves the same function as the groove 60 of the first embodiment.

The engagement portion 132 also includes hook-like projections 62 that extend radially outwardly and rearwardly from the edges of the walls 141. The projections 62 are also not parallel, but are splayed apart from one another. The projections 62 serve three functions. The first function is similar to that provided by the splayed apart portions 43 of the guide plates 41 of the first embodiment of the engagement portion 32, in that these projections 62 provide a taper to the opening 154 so that a rope may more easily enter the channel to be seated in the channel 142.

The second function is to serve as a general purpose hook, for example to be used when retrieving a loose section of rope or any other object that would otherwise be outside the reach of a user of the apparatus.

The projections 62 are generally triangular in shape and terminate at backwardly directed tips 66. The projections 62 each extend from a central portion 64 of the cylindrical guide means 140. The projections 62 are arranged such that the gap between the tips 66 of the projections 62, furthest from the guide means 140, is greater than the width of the U-shaped channel 142, as shown most clearly in FIG. 7; this aids alignment and insertion of the rope within the channel 142. In addition, the projections have backwardly tapered front edges 68, the slope of which is continuous with the tapered end region 148 of the guide means 140. The third function provided by the projections 62 is therefore to extend the surfaces forming the tapered end 148 of the engagement portion 132 on the side of the guide means 140 opposite the hollow cylindrical portion 135.

A sloped surface 70 is formed in a rear section 72 of the guide means 140 behind the portion of the walls 141 from which the projections 62 extend. Rear edges 71 of the projections 62 are sloped at an opposite angle to these sloped surfaces 70 relative to the axis 57 of the guide means 140. These oppositely sloped surfaces 70, 72 provide a generally triangular recess 74 in the engagement portion 132. The recess 74 provided by the projections 62 and the rear section 72 of the guide means 140 can therefore be used to snag a section of rope at a distance from a user when retrieving said section of rope. In use, the projections 62 of the engagement portion 132 may be passed under a length of rope so that the rope is pulled up into the triangular recess 74. The rope can then be lifted over an object or dragged towards the user to retrieve the length of rope. In other embodiments (not shown), the projections 62, instead of having substantially straight sides 68, 71 may be curved in the form of a curved hook.

As mentioned above, the tapered end region 148 of the guide means 140 includes a part-annular groove 160 extending around the front portion of the cylindrical guide means 140 as far the channel 142. The receiving means 112 includes a corresponding annular ridge 180 which forms an outer lip on the rim 128 of the conical receptacle 126. The ridge is split into ridge portions by the slots 81 defining the fingers 82 and is directed radially inwards so that this may engage with the groove 160. The positions of the groove 160 and ridge 180 are such that the ridge locates in the groove when the tapered end 48 of the engagement portion 32 is inserted into the conical receptacle 26 of the receiving means 112. The ridge 180 has a smaller inner diameter than the tapered end portion 148 adjacent the groove, and so as the tapered end region 148 is pressed into the conical opening 127, the fingers 82 flex outwardly until the ridge portions 180 snap into engagement with the groove 160. The groove 160 and ridge 180 therefore engage to positively retain the end 150 of the manipulating member 116 in the conical receptacle 126 during use. The manipulating member can be easily removed from the receiving means by pulling sharply on the handle to disengage the groove and ridge.

In an alternative embodiment (not shown) the ridge may be located on the engagement portion and the groove may be formed within the conical receptacle. Alternatively, other retaining means may be used to retain the end of the manipulating member in the receiving means during use, for example, magnetically attractive components provided on the receiving means and engagement portion.

Figure 10:
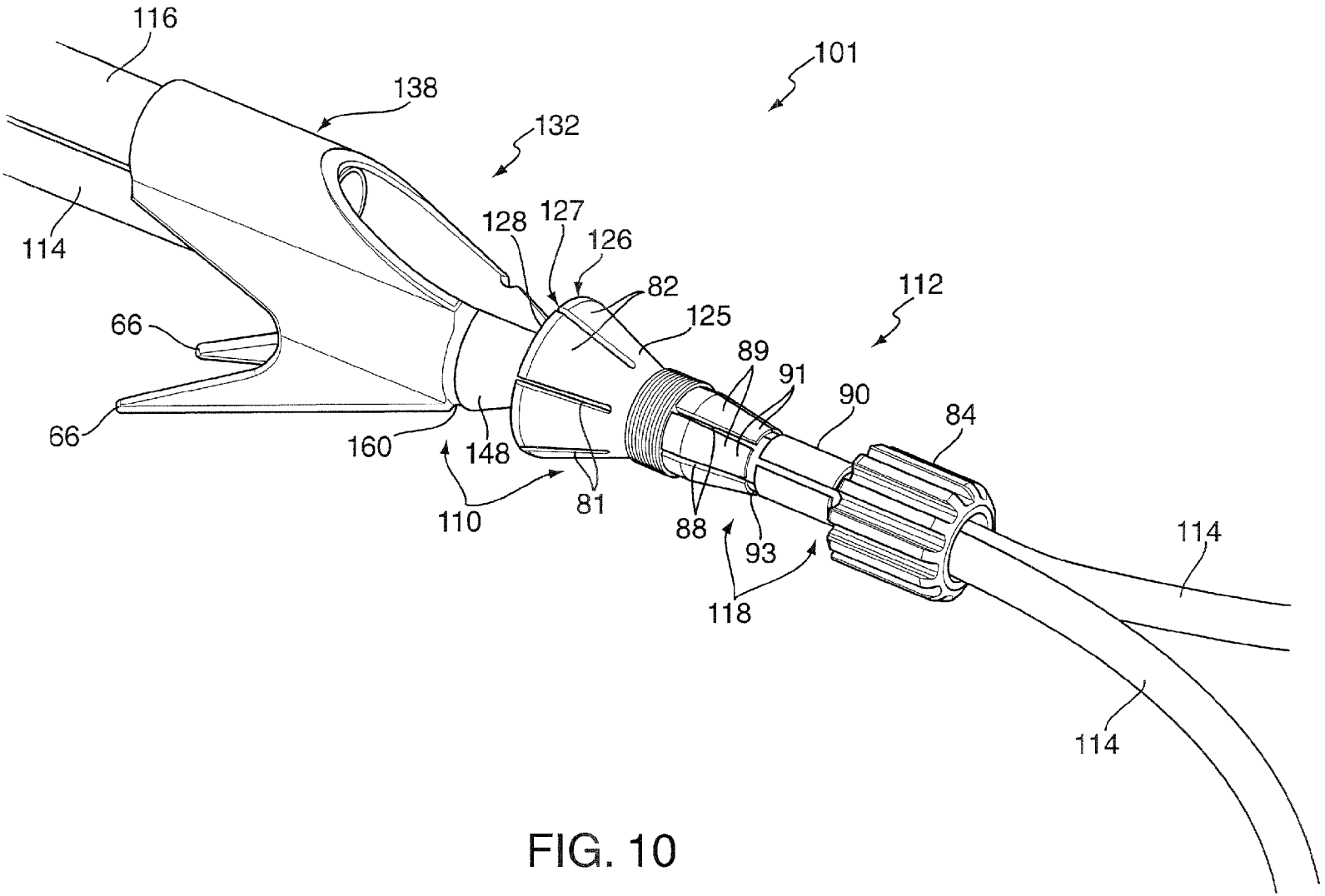
FIG. 10 is a perspective view of the rope handling apparatus of FIG. 5, showing the engagement portion aligned along an axis of the assembly to be received by the receiving means, and showing how the rope is clamped within the receiving means.
Figure 11:
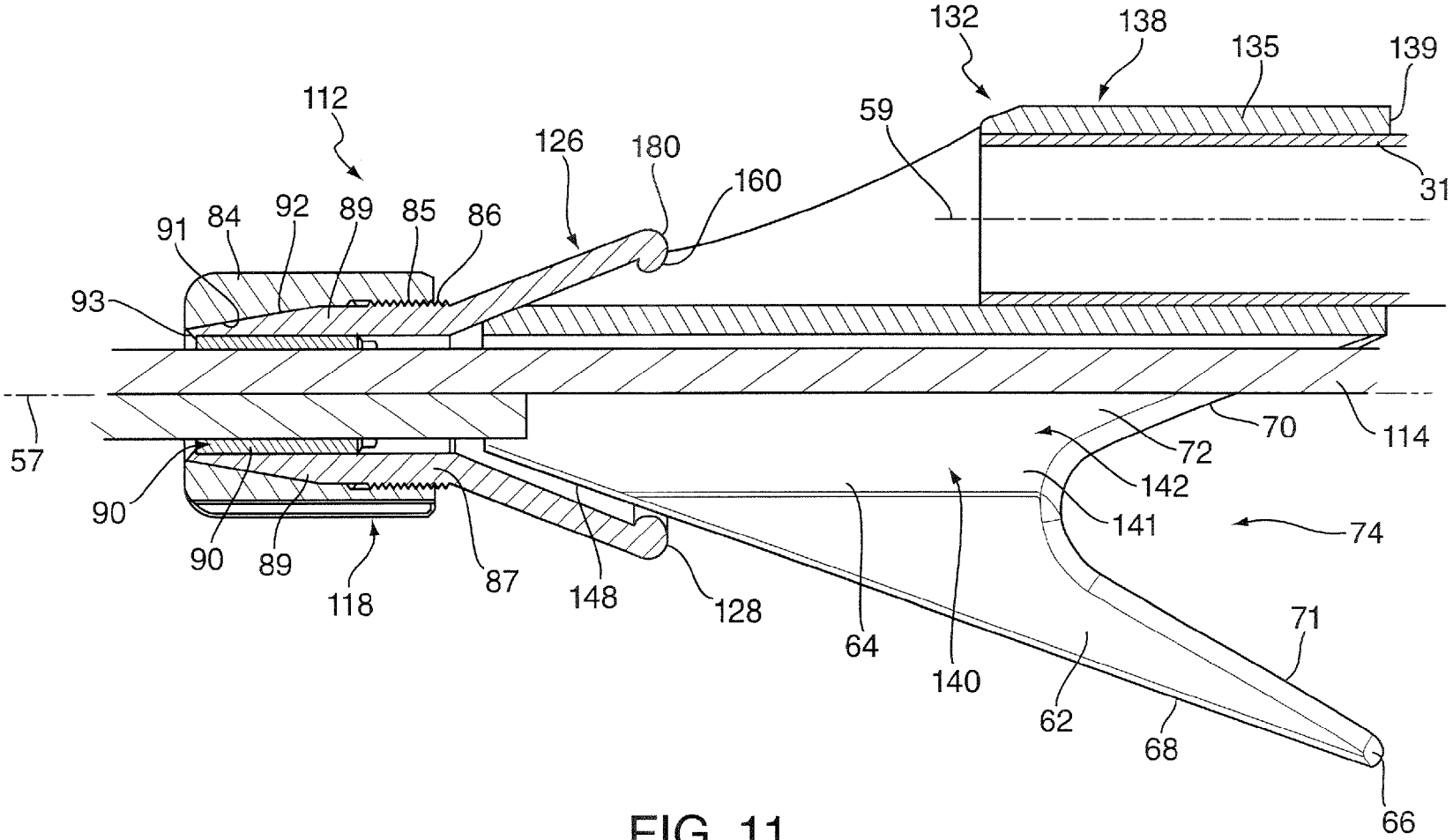
FIG. 11 is a cross-section through the engagement portion, receiving means and rope of FIG. 5.

FIGS. 10 and 11 show how the receiving means 112 may be fixed the rope 114. The compression nut 84 of the rope clamping assembly 118 has internal threads 85 which are screwed to corresponding external threads 86 on a hollow cylindrical base portion 87 of the receiving means 112 from which the conical receptacle 126 extends. The base portion 87 is split by axially extending slots 88 into plurality of fingers 89 which extend forwards from the receptacle. Each finger has an outer wedge surface 91 such that the diameter of each finger tapers inwards towards its tip 93. The taper permits the internal threads 85 to pass more easily over the fingers 89 when the nut is being engaged with the external threads 86.

The clamping assembly 118 also comprises a split sleeve 90, which may be made from an elastomeric material such as rubber, which is inserted between the rope 114 and the fingers 88. The thickness of the split sleeve 90 may be varied to accommodate different diameters of rope.

The base portion 87, the receptacle 126 and the fingers 89 are all of one-piece construction, made from the same hard but flexible and resilient plastic material.

The compression nut 84, which is also made from a hard plastic material, has an internal wedge surface 92 which is inclined at the same angle as the external wedge surface 91 of the fingers, so that these wedge surfaces conform as the threads 85, 86 are tightened. The contact between the wedge surfaces 91, 92 then causes each finger 89 to flex inwards and compress the split sleeve 90 and the rope 114 held within the split sleeve as the nut is fully tightened, thereby clamping the rope securely within the rope clamping assembly 118. The fingers 89 and split sleeve 90 therefore act as a compression sleeve.

It will be appreciated that the rope handling apparatus of the present invention may be used to manipulate a length of rope in a number of situations in which it is impractical or difficult to move closer to the location of interest. Because the guide means 40, 140, in use, aligns the manipulating member 16, 116 with the rope 14, 114 as the guide means is brought into contact with the rope, for example as the engagement portion 32, 132 is slid along the rope towards the receptacle 26, 126. Because the guide means is part of the engagement portion the engagement portion is also self-aligned with the receptacle, so that this enters the receptacle automatically prior to full engagement of the engagement portion within the receptacle.

The apparatus of the present invention may be used with a number of items of safety equipment such as personal rescue devices to enable them to be passed out to a person in distress. For example, receiving means may be located on a part of a life ring. Usually a life ring is thrown to a person in distress in the water, with a length of rope attached to the life ring to enable it to be pulled back towards the shore or a boat. However, it is difficult to throw the life ring accurately and it is difficult to catch or make contact with the life ring when it has been thrown. By using the rope handling apparatus of the present invention, the end of the manipulating member may be located in the receiving means and can then be used to pass the life ring out to the person in distress, even if they are at a significant distance from the rescuer.

The rope handling apparatus may also be used with rescue slings or man overboard slings. These typically comprise a padded sling that loops under the arms and around the back of a person in the water to allow them to be lifted to safety. However, when a person has been in the water a long time and is cold and tired it is difficult for then to hold the sling and manoeuvre it into the correct position around their body. By using the rope handling apparatus of the present invention, the receiving means could be attached to the rope close to the sling and the manipulating member could be used to pass the sling out to a person to be rescued and could then be used to hold the sling in position over their head. The person would then simply be able to put their arms through the sling without having to hold the sling in position themselves.

In general, the rope handling apparatus of the present invention may be used to move and manipulate any length of rope at a distance from the user. In the context of the present invention, the term "rope" includes any type of rope, string or cable, formed from any suitable material, whether braised or not, formed from any suitable material, for example hemp, nylon or other plastic material, wire, or cord.

The invention therefore provides a convenient means for handling a length of rope.

The invention claimed is:

1. A rope handling apparatus comprising a receiving means and a manipulating member, the receiving means and manipulating member being individual devices which, in use, are engageable with each other when a rope is to be manipulated, and then disengageable with each other after the rope has been manipulated, in which:

the manipulating member has an elongate portion, the elongate portion having opposite ends, and at one or both of said ends an engagement portion;

the receiving means has a rope mounting portion configured to be fixed to a part of a rope to be manipulated, and a receptacle for engaging with the engagement portion when the rope is to be manipulated and for disengaging with the engagement portion after the rope has been manipulated, the rope mounting portion being configured to remain fixed to the rope after the engagement portion and receptacle have been disengaged;

wherein the receiving means when engaged with the engagement portion at one of said ends of the elongate portion permits a user of the apparatus to hold the manipulating member at an opposite end of the elongate member in order to handle a rope attached to the rope mounting portion, the rope handling apparatus further comprising a guide means for self-aligning the manipulating member with a rope prior to engagement of the engagement portion with the receptacle, and the guide means being part of the engagement portion such that, in use, the guide means automatically aligns the engagement portion with the receptacle and guides a front end of the guide means into engagement with the receptacle as the guide means is slid along said rope towards the receptacle.

2. A rope handling apparatus as claimed in claim 1, in which the receptacle comprises a tapered opening and the engagement portion comprises a tapered end region and in which the tapered end region fits within the tapered opening of the receptacle.

3. A rope handling apparatus as claimed in claim 1, in which the elongate portion comprises a handle portion.

4. A rope handling apparatus as claimed in claim 1, in which the elongate portion is telescopic.

5. A rope handling apparatus as claimed in claim 1, in which the guide means in use, aligns the manipulating member with the rope as the engagement portion is slid along the rope towards the receptacle.

6. A rope handling apparatus as claimed in claim 1, in which the guide means comprises a channel in which a rope may be seated for self-aligning the manipulating member with said rope.

7. A rope handling apparatus as claimed in claim 1, in which the rope mounting portion includes a generally cylindrical rope clamping assembly to secure the receiving means to a rope.

8. A rope handling apparatus as claimed in claim 7, in which said rope clamping assembly comprises a cylindrical sleeve, said sleeve being made from a heat shrinkable material.

9. A rope handling apparatus as claimed in claim 8, in which said rope clamping assembly comprises O-rings that extend around said cylindrical sleeve for securing the cylindrical sleeve to a rope.

10. A rope handling apparatus as claimed in claim 7, in which said rope clamping assembly comprises a compression nut and a compression sleeve.

11. A rope handling apparatus as claimed in claim 1, in which the receiving means and manipulating member comprise retaining features for positively retaining an end region of the engagement portion in the receptacle when the rope handling apparatus is used to manipulate a rope.

12. A rope handling apparatus as claimed in claim 11, in which the retaining features comprise a groove on one of either the receiving means or the engagement portion and a ridge on the other of either the receiving means or the engagement portion, and in which the ridge is locatable in the groove for positively retaining the end of the engagement portion in the receptacle.

13. A rope handling apparatus as claimed in claim 1, in which the engagement portion includes at least one projection for snagging a section of rope at a distance from a user when retrieving said section of rope.

14. A rope handling apparatus as claimed in claim 13, in which said at least one projection is a hook.

15. A rope handling system, comprising a rope and a rope handling apparatus for manipulating said rope, the rope handling apparatus comprising a receiving means and a manipulating member, the receiving means and manipulating member being individual devices which, in use, are engageable with each other when a rope is to be manipulated, and then disengageable with each other after the rope has been manipulated, in which:

the manipulating member has an elongate portion, the elongate portion having opposite ends, and at one or both of said ends an engagement portion;

the receiving means has a rope mounting portion, said rope mounting portion being fixed to a part of said rope, and a receptacle for engaging with the engagement portion when the rope is to be manipulated and for disengaging with the engagement portion after the rope has been manipulated, the rope mounting portion being configured to remain fixed to the rope after the engagement portion and receptacle have been disengaged;

wherein the receiving means when engaged with the engagement portion at one of said ends of the elongate portion permits a user of the apparatus to hold the manipulating member at an opposite end of the elongate member in order to handle said rope attached to the rope mounting portion, the rope handling apparatus further comprising a guide means for self-aligning the manipulating member with said rope prior to engagement of the engagement portion with the receptacle, and the guide means being part of the engagement portion such that, in use, the guide means automatically aligns the engagement portion with the receptacle and guides a front end of the guide means into engagement with the receptacle as the guide means is slid along said rope towards the receptacle.

16. A rope handling system as claimed in claim 15, in which said rope includes a loop, the rope mounting portion being attached to said rope proximate the loop.

17. A method for handling a rope, using a rope handling apparatus, said apparatus comprising a receiving means, a manipulating member and a guide means, the manipulating member having an elongate portion, the elongate portion having opposite ends, and at one or both of said ends an engagement portion, the guide means being part of the engagement portion and the receiving means having a rope mounting portion and a receptacle, the method comprising the steps of:

attaching the rope mounting portion to a part of a rope to be manipulated;

engaging the engagement portion with the receptacle; and holding the manipulating member at an opposite end of the elongate member to that of said engaged engagement portion in order to handle said rope;

wherein prior to said engagement of the engagement portion with the receptacle, the guide means is used to self-align the manipulating member with said rope, the guide means then automatically aligning the engagement portion with the receptacle and guiding a front end of the guide means into engagement with the receptacle as the guide means is slid along said rope towards the receptacle.

18. A method for handling a rope as claimed in claim 17, in which the guide means is part of the engagement portion such that as the manipulating member is self-aligned with the rope, the engagement portion is automatically aligned with the receptacle.

* * * * *